United States Patent [19]

Wieweck

[11] 4,217,878

[45] Aug. 19, 1980

[54] BIOMASS FUELED FURNACE

[76] Inventor: Gregory J. Wieweck, Box 81, Stewart, Minn. 55385

[21] Appl. No.: 24,945

[22] Filed: Mar. 29, 1979

[51] Int. Cl.[3] ..... F24H 3/02

[52] U.S. Cl. ..... 126/110 R; 126/121; 237/55; 237/51; 165/DIG. 2

[58] Field of Search ..... 237/50, 51, 53, 55; 432/223, 179; 165/DIG. 2; 126/121, 110 R, 110 E

[56] References Cited

U.S. PATENT DOCUMENTS

| | | | |
|---|---|---|---|
| Re. 5,871 | 5/1874 | Twitchell | 237/55 |
| 1,931,339 | 10/1933 | Zingone | 237/50 |
| 2,277,381 | 3/1942 | Black | 237/51 |
| 2,619,022 | 11/1952 | Hergenrother | 237/55 X |
| 3,150,656 | 9/1964 | Huber | 126/110 E |
| 3,353,529 | 11/1967 | Kovats | 126/110 E |
| 3,934,798 | 1/1976 | Goldsmith | 237/55 |
| 3,944,136 | 3/1976 | Huie | 237/55 |
| 4,043,313 | 8/1977 | Sherman | 126/121 |
| 4,047,515 | 9/1977 | Daniel | 126/110 |
| 4,147,303 | 4/1979 | Talucci | 237/55 |

*Primary Examiner*—Henry C. Yuen

*Attorney, Agent, or Firm*—Kinney, Lange, Braddock, Westman and Fairbairn

[57] ABSTRACT

A furnace for burning biomass such as crop residues like cornstalks and other combustibles. The furnace includes a combustion chamber and many chimney stacks extending upwardly therefrom. Loading doors are provided into the combustion chamber to permit massive batches of combustibles to be deposited in the chamber. Centrifugal combustion air draft fans are positioned to deliver forced combustion air from the atmosphere into a lower part of the chamber when needed. A heat exchanger jacket encompasses major parts of the chamber and of the stacks and is provided with an upper opening adjacent the top of the stacks and a lower opening adjacent the bottom of the chamber. Drying air to be heated enters one of the openings and heated drying air discharges from the other. Fan means adjacent the lower opening moves the drying air through the heat exchange jacket and into a crop dryer or other location for use. The drying air discharge temperature is monitored by a sensor which controls the combustion air draft fans to maintain the discharging heated drying air within predetermined temperature limits.

3 Claims, 6 Drawing Figures

BIOMASS FUELED FURNACE

BACKGROUND OF THE INVENTION

This invention has relation to the use of cornstalks, oat, wheat and bean straw and other crop residues as a heat energy source for combustion in a furnace to provide heated air for crop drying and for other purposes.

Corn coming from the field with approximately 25% moisture content or more is preferably dried to about 13% moisture content for storage. Typically this is done by use of a propane heater feeding heated air to the bottom of a column of shelled corn in a crop dryer bin. Such heaters are direct fired, and the products of combustion of the propane and air are forced through the crop from below.

This invention relates to burning of crop residue biomass to replace the burning of propane or other off-farm energy sources.

Attempts have been made to utilize straw or other biomass to dry corn by forcing the products of combustion directly into the crop dryer, but this results in black, sooty, contaminated corn.

Applicant has caused no preliminary search of the prior art to be made in the records of the United States Patent and Trademark Office; but has contacted scientists at the University of Minnesota and at Iowa State University, and found that research has been going on only at Iowa State and that it was still in the analytical stage. Applicant and those in privity with him know of no closer prior art than that referred to above; and they know of no prior art which anticipates the claims made in this application.

BRIEF SUMMARY OF THE INVENTION

A combustion chamber is provided with a loading door means opening which is large enough so that large stacks or bales of biomass or other combustible material can be loaded into it. In the form of the invention disclosed, the furnace can hold approximately one ton of such material.

The chimney for the combustion chamber consists of a plurality of vertical, spaced-apart stacks open from the top of the combustion chamber to the outside air a sufficient distance above the combustion chamber to eliminate or minimize any problem with the heat and combustion products being discharged therefrom.

A heat exchanger is constituted as a chimney jacket in spaced, surrounding relationship to the vertical stacks and a combustion chamber jacket in spaced relationship to the combustion chamber on all sides thereof except that area taken by the loading door means.

A dryer fan is used to move outside air through the heat exchanger to extract heat from the combustion chamber and chimney and then to force the then heated air into the crop dryer bin or to other locations for use. A temperature sensor is situated to monitor the temperature of the air coming out from the heat exchanger. This sensor controls separate draft fan means which introduces forced air for combustion into the combustion chamber when the temperature of the heat exchanger discharge air falls below a predetermined range, and terminates such forced air flow when the heat exchanger discharge air temperature goes above that range.

IN THE DRAWINGS,

FIG. 1 is an elevational view with parts in section and parts broken away showing a first form of biomass fueled furnace of the present invention in relationship to an overhead type crop dryer;

DESCRIPTION OF PREFERRED EMBODIMENTS

First Form of the Invention

Figures 2, 3:
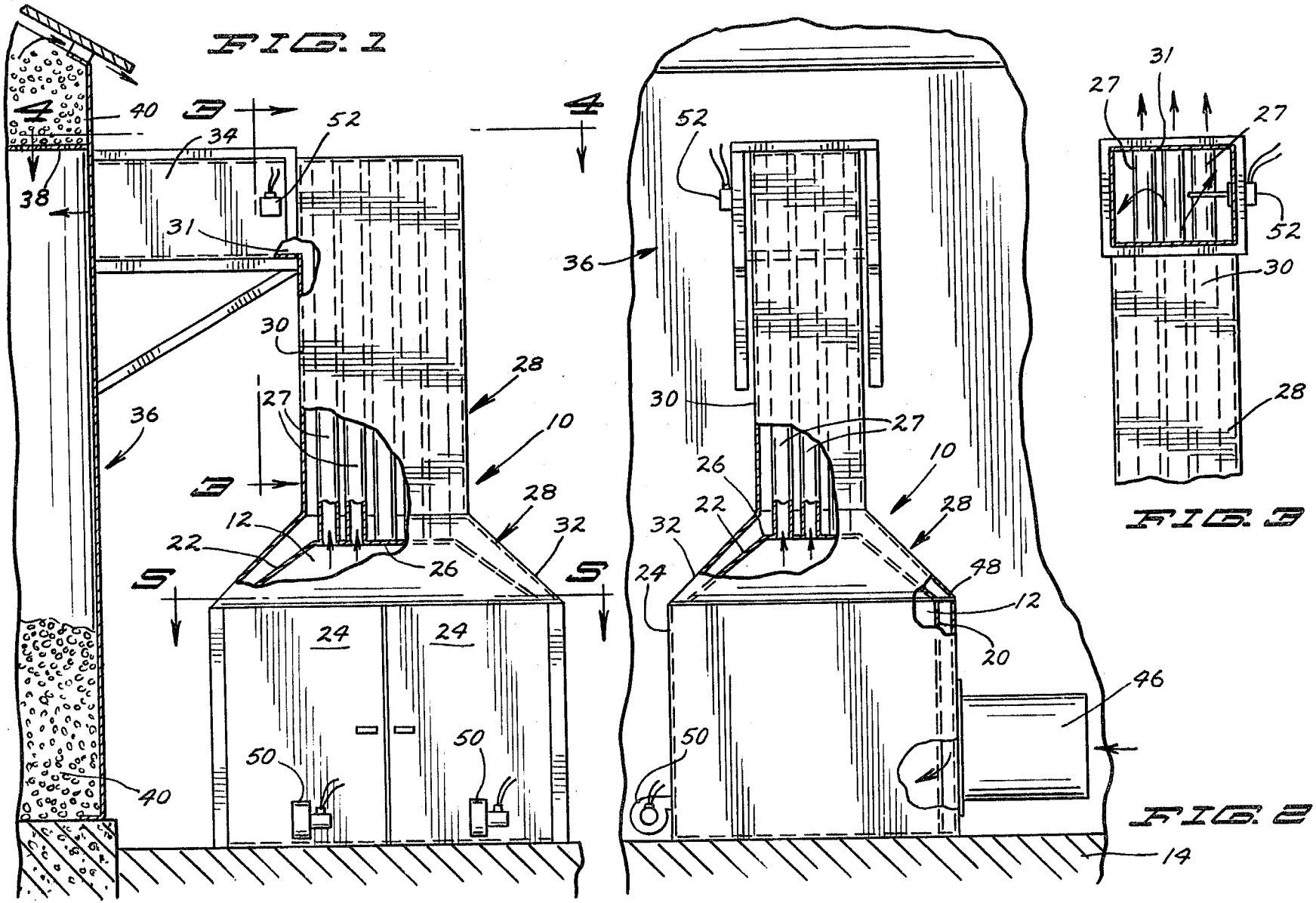
FIG. 2 is a side elevational view of the furnace of FIG. 1.
FIG. 3 is a fragmentary vertical sectional view taken on the line 3—3 in FIG. 1.

Referring now to FIGS. 1 through 5, a furnace 10 is burning biomass material such as cornstalks, straw, and other low-cost crop residues or otherwise unwanted combustibles. It includes a combustion chamber 12 defined by a concrete floor 14, upright side walls 16 and 18, a back wall 20, a bonnet or cap 22, and loading door means 24 hingedly connected to forward edges of the upright side walls 16 and 18.

The bonnet or cap 22 has a horizontal portion 26. A plurality of spaced-apart, vertical, cylindrical chimney stacks 27 are open through that portion 26 and are open high above the combustion chamber. These stacks 27 are for the purpose of carrying the products of combustion including gases and ashes out of the combustion chamber.

A heat exchanger 28 includes a chimney jacket 30 in spaced, surrounding relation to all of the chimney stacks 27; and an integrally connected combustion chamber jacket 32 in spaced relation to the side walls 16 and 18, the back wall 20 and the bonnet or cap 22.

A drying air delivery duct 34 extends from a drying air discharge opening 31 in an uppermost portion of the chimney jacket 30 to deliver heated drying air from the heat exchanger 28 to an overhead type crop dryer 36. Although forming no part of the present invention, the dryer 36 includes a perforated floor 38 for supporting a layer of shelled corn 40 to be dried. The heated air from the heat exchanger 28, flows up through the perforated floor and up through the shelled corn and out of the crop dryer thus to dry the corn.

Figure 4:
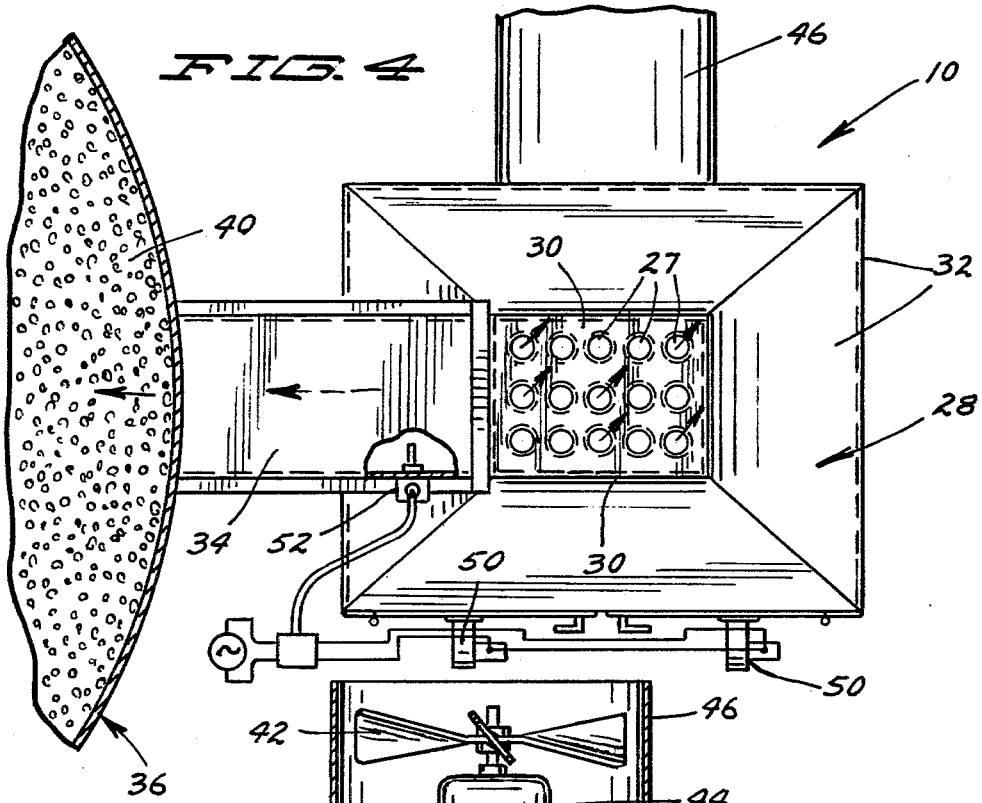
FIG. 4 is a top plan view of the furnace and a portion of the overhead crop dryer of FIGS. 1 through 3.
Figure 5:
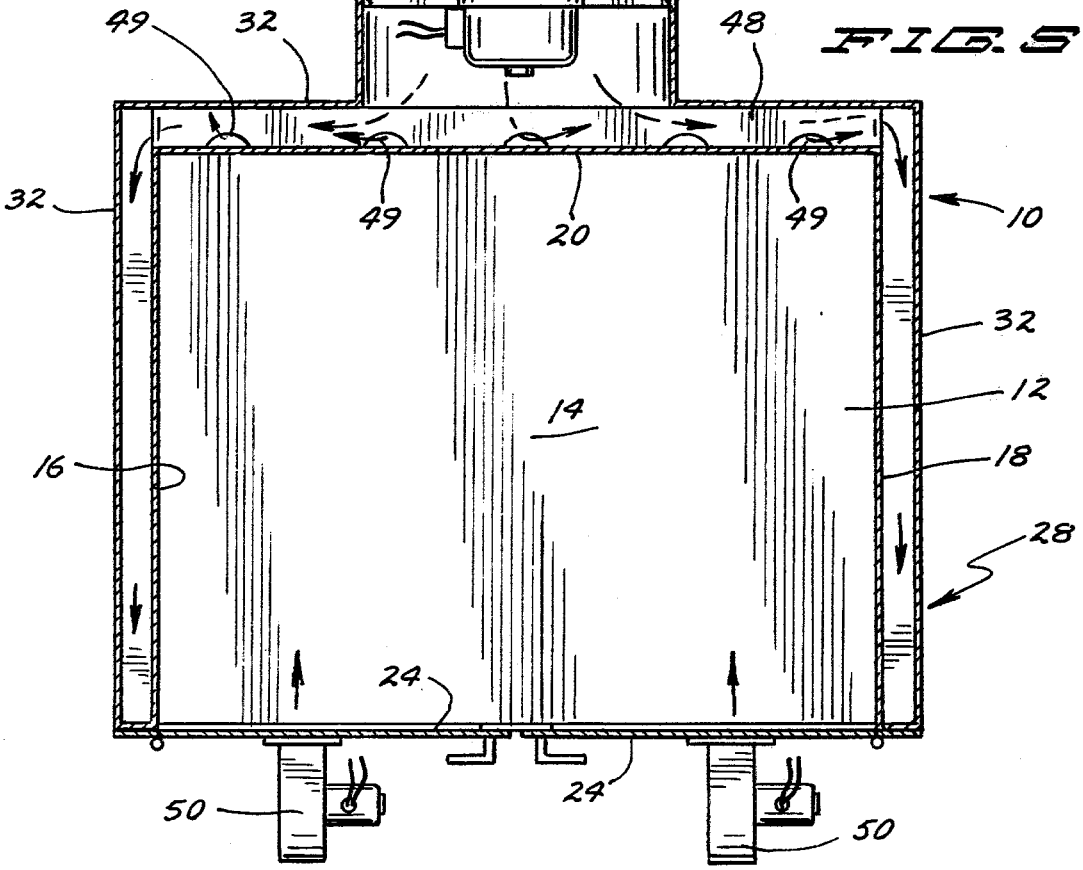
FIG. 5 is an enlarged horizontal sectional view taken on the line 5—5 in FIG. 1.

In the first form of the invention, air is forced through the heat exchanger by a drying air fan 42 and drying air fan motor 44, both mounted in the center of a drying air fan intake conduit 46. As seen in FIGS. 2, 4 and 5, this conduit 46 is open through the heat exchanger wall of combustion chamber jacket 32 to force air immediately against the back wall 20 of the combustion chamber. In order to insure that a substantial and sufficient amount of dryer air be forced around in contact with the side walls 16 and 18 of the combustion chamber, a horizontally situated baffle plate 48 is welded onto the top edge of the back wall 20 and onto the top edge of that vertical portion of the combustion chamber jacket 32 which is adjacent to, parallel to, and spaced from the back wall 20. This baffle plate 48 is provided with a plurality of openings 49 therethrough to permit some air to proceed up the back side of the bonnet and into the chimney jacket 30, while forcing more heat exchange air around inside of the combustion chamber jacket 32 and so into contact with the side walls 16 and 18, before going up into the chimney jacket 30.

Forced furnace draft means constituted as a pair of centrifugal combustion air draft fans 50,50 are mounted, one in each of the loading doors 24. A drying air temperature sensor 52 is mounted in adjacent relationship to the opening 31 in the uppermost portion of the chimney jacket 30. In the form of the invention shown, it is mounted in the drying air delivery duct 34, but could just as well be mounted to or in the chimney jacket 30.

Suitable control and power electrical circuitry of any usual or preferred construction (not shown) provides the power to drive the fans 50,50 whenever the sensor 52 indicates that the output temperature of the drying air is below a predetermined range, and to interrupt power to the fans 50,50 when this air temperature exceeds the predetermined range.

Operation of First Form of Furnace

The loading door means or doors 24,24 are swung open wide, and a fork lift truck or other suitable means is used to transport approximately one ton of bailed or stacked corn husks or other biomass material into the center of the combustion chamber. If ignited fuel from the previous load is in the combustion chamber, it will often ignite the new charge of biomass material. If not, the material can be lit with a match, or with a propane torch, or otherwise. The doors 24,24 are then closed, the drying air fan motor 44 activated, and power supplied to the circuits to operate the furnace draft fans 50,50.

Initially the temperature of the dryer air available to the delivery duct 34 will be the ambient temperature, and sensor 52 will cause the combustion air draft fans 50,50 to provide forced air into the combustion chamber to cause the biomass material to burn with great vigor, causing the combustion chamber walls and the vertical chimney stacks to be heated. As the air in the heat exchanger picks up this heat, the temperature of the air furnished to the delivery duct 34 will eventually reach about a 125° F. (51.6° C.) temperature, at which time the sensor will cause the power to the combustion air draft fans to be terminated.

With the termination of delivery of forced air, combustion will continue in the combustion chamber, but will be in the form of a flowing rather than a flaming. More important, the heated products of combustion will rise in the chimney stacks under their own impetus rather than being forced out by the intake of air from the combustion draft fans, so the temperature of the combustion chamber and these chimney stacks will rise appreciably, at the time the combustion fans are turned off. The loss of heat energy from the stacks substantially decreases at the same time. The heat exchange drying air will pick up heat from these combustion chamber and chimney stack surfaces, and will deliver it, under the impetus of the drying air fan 42, through the drying air delivery duct 34 to the crop dryer 36.

There will be a gradual cooling of the glowing biomass materials due to a deficiency of air or oxygen for combustion, and this will, in due course, affect the temperature at the sensor 52. When the sensor temperature reaches a predetermined point, such as 118° F. (48° C.), the sensor will again activate the combustion air draft fans 50,50 and they will supply air to the biomass materials to again cause the combustion to proceed at a flaming and rapid rate.

Second Form of the Invention

Figure 6:
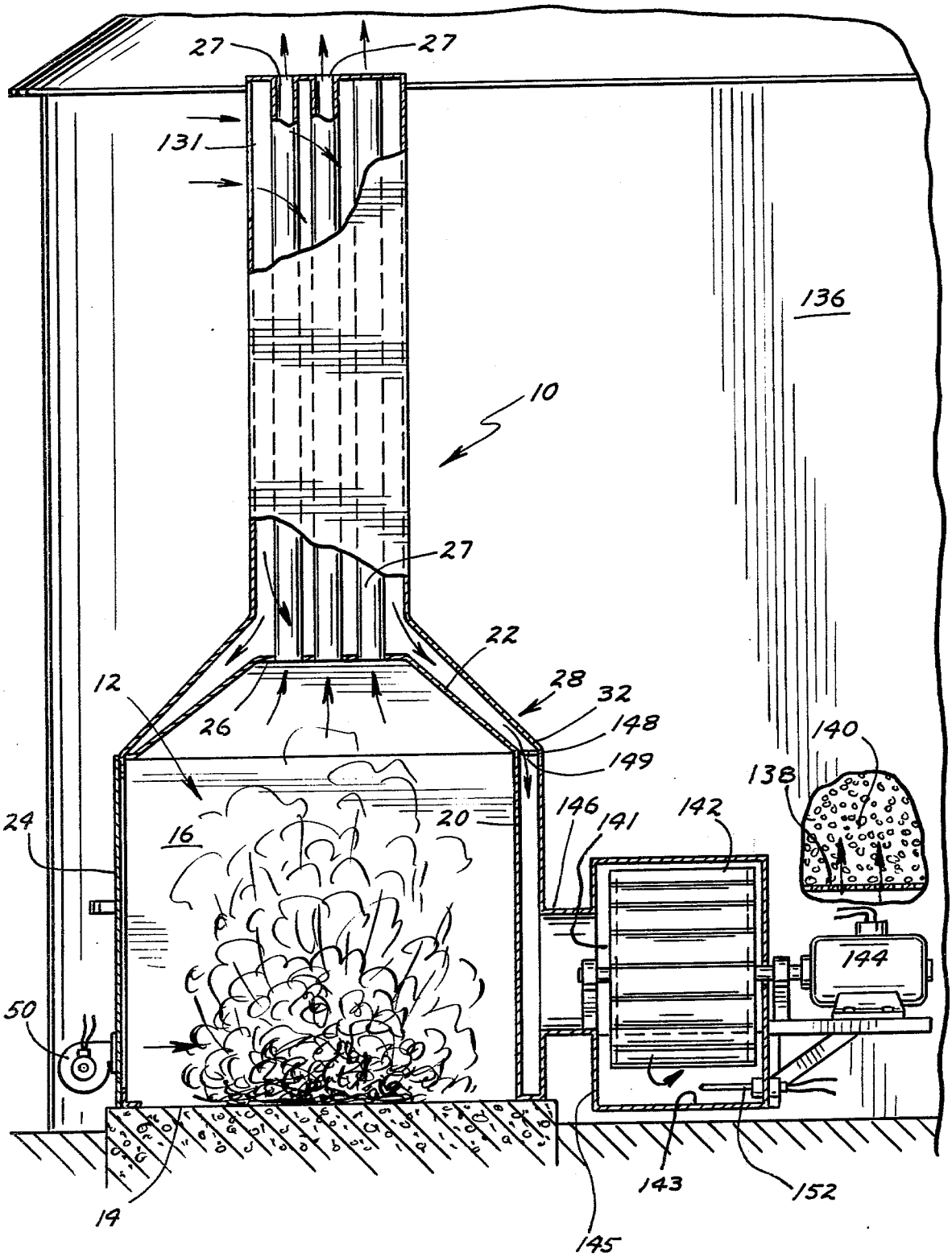
FIG. 6 is a side elevational view with parts in section and parts broken away of a second form of biomass fueled furnace of the invention shown in association with a crop dryer bin which receives its drying air at the bottom thereof.

Referring now to FIG. 6, a biomass furnace 10 is substantially identical in construction to that disclosed in connection with FIGS. 1 through 5 of the first form of the invention, and similar parts are similarly numbered. This second form of the invention, however, is designed to provide heated drying air to the bottom drying air type crop dryer 136. In such a dryer, shelled corn 140 rests on a perforated floor 138, and heated drying air is delivered beneath the perforated floor through an opening 141 provided in the side wall of the crop dryer 136.

A drying air intake opening 131 is provided in the uppermost portion of the chimney jacket 30, and it is through this opening that the drying air is drawn into the heat exchanger 28. A hot air delivery duct 146 is open from opening 141 to the center of a centrifugal drying air fan 142, and this fan discharges into a crop dryer inlet duct 143 which is open from a fan housing 145 to the lower interior portion of the crop dryer 136. The drying air fan 142 has a fan housing 145 and is driven by motor 144.

A drying air temperature sensor 152 is situated in drying air intake opening 131, and is connected to the combustion air draft fans 50,50 to hold the discharge temperature in some predetermined range, for example, 118° to 125° F. (48° to 51.6° C.).

If desired, a baffle plate 148 with openings 148 can be provided.

Operation of Second Form of Furnace

The operation of the biomass furnace is essentially exactly the same as in the case of the first form of the invention. The biomass materials are loaded into the combustion chamber through the loading door means 24, and the door is shut after the biomass materials are ignited. The combustion air draft fans come on periodically to maintain the drying air within the desired range.

In connection with both forms of the invention, the ash formed in the combustion chamber is carried with the other products of combustion, out through the chimney stacks and falls out in due course under the force of any prevailing wind, back on the ground from whence it came. There being no deliterious substances in the biomass materials except those which were extracted from the ground in the growing process in the first place, there is no pollution of the ground after these particles separate out from the air.

The alternating flame-glow sequence of combustion allows the furnace to operate under the "glow" phase for most of the time; and during that time, there is a very appreciable reduction in the temperature of the flue gases, and consequently a very substantial increase in the burning efficiency in terms of heat energy units delivered in hot air from the furnace compared to the heat energy units being released during combustion.

The embodiments of the invention in which an exclusive property or privilege is claimed are defined as follows:

1. A hot air furnace including:

A. a combustion chamber, said chamber being provided with means to accept a charge of combustible materials initially filling a major portion of it;

B. a chimney open to and extending upwardly from the combustion chamber;

C. a heat exchange jacket adjacent to, encompassing and spaced from a major portion of said chimney, said jacket being provided with an upper opening adjacent an upper portion of said chimney and a lower opening adjacent said combustion chamber;

D. first fan means adjacent one of said jacket openings for moving air into said jacket by way of a first of said openings, through said jacket and out of said jacket by way of a second of said openings;

E. second fan means open to the interior of said combustion chamber and adapted, when operable, to supply a forced draft of combustion air to the interior of said chamber;

F. temperature sensor means situated to monitor the temperature of air discharging from said second jacket opening;

G. control means to render said second fan means operable when said discharging air temperature is below a predetermined temperature range and to render said means inoperable when said air temperature is above said range;

H. said heat exchange jacket being also adjacent to, encompassing and spaced from a major portion of said combustion chamber;

I. said lower opening in said heat exchange jacket being adjacent a lower portion of said combustion chamber;

J. said chimney being constituted as a plurality of spaced apart chimney stacks open through a top wall of said combustion chamber and terminating above said chamber;

K. said first fan means being situated adjacent said lower heat exchange jacket opening;

L. said means to provide access to load fuel into said combustion chamber being constituted as openable door means, which, when closed, constitutes a front wall of the combustion chamber;

M. said second fan means being mounted with respect to a first substantially vertical combustion chamber wall and being open through said first vertical wall to the interior of said combustion chamber;

N. said combustion chamber being provided with a second substantially vertical wall in substantially opposed relationship with respect to said first wall;

O. said heat exchange jacket being provided with an upright wall in adjacent, parallel, spaced-apart relationship with respect to said second combustion chamber vertical wall;

P. said heat exchange jacket vertical wall being provided with said lower opening therethrough; and Q. a baffle plate being integrally connected between top edges of said combustion chamber second vertical wall and said heat exchange jacket vertical wall, said baffle plate being provided with a plurality of drying air transmitting openings therethrough.

2. The furnace of claim 1 wherein:

R. said first fan means being constituted as a centrifugal fan; and

S. said first fan means moving said heat exchange air into said jacket by way of said upper opening and out of said jacket by way of said lower opening.

3. The furnace of claim 1 wherein:

R. said first fan means moves air into said jacket by way of said lower opening and out of said jacket by way of said upper opening.

* * * * *